US009097006B2

(12) United States Patent
Johnson et al.

(10) Patent No.: US 9,097,006 B2
(45) Date of Patent: Aug. 4, 2015

(54) DRAINAGE SYSTEM FOR USE IN BUILDING CONSTRUCTION

(71) Applicant: Mortar Net USA, Ltd., Burns Harbor, IN (US)

(72) Inventors: Gary R. Johnson, Gary, IN (US); Tom Sourlis, Highland, IN (US)

(73) Assignee: Mortar Net USA, Ltd., Burns Harbor, IN (US)

( * ) Notice: Subject to any disclaimer, the term of this patent is extended or adjusted under 35 U.S.C. 154(b) by 0 days.

(21) Appl. No.: 13/748,392

(22) Filed: Jan. 23, 2013

(65) Prior Publication Data

US 2014/0202096 A1 Jul. 24, 2014

Related U.S. Application Data

(60) Provisional application No. 61/589,653, filed on Jan. 23, 2012.

(51) Int. Cl.
*E04B 1/70* (2006.01)
*E04B 1/64* (2006.01)

(52) U.S. Cl.
CPC ..... *E04B 1/64* (2013.01); *E04B 1/7038* (2013.01); *E04B 1/7046* (2013.01); *E04B 1/7061* (2013.01)

(58) Field of Classification Search
CPC ..... E04B 1/70; E04B 1/7038; E04B 1/7046; E04B 1/7061
USPC ..... 52/58, 62, 97, 169.5, 302.1, 302.6, 52/716.2, 717.03, 717.04
See application file for complete search history.

(56) References Cited

U.S. PATENT DOCUMENTS

| | | | | |
|---|---|---|---|---|
| 6,023,892 | A * | 2/2000 | Sourlis | 52/169.5 |
| RE36,676 | E * | 5/2000 | Sourlis | 52/169.5 |
| 6,964,136 | B2 * | 11/2005 | Collins et al. | 52/209 |
| 7,448,175 | B2 * | 11/2008 | Sourlis | 52/302.1 |
| 7,543,414 | B2 * | 6/2009 | Sourlis | 52/169.5 |
| 7,730,685 | B1 * | 6/2010 | Keene | 52/302.4 |
| 7,836,640 | B1 * | 11/2010 | Pratt | 52/61 |
| 8,046,956 | B1 * | 11/2011 | Hohmann, Jr. | 52/62 |
| 2002/0115367 | A1 * | 8/2002 | Lolley et al. | 442/6 |
| 2004/0093806 | A1 * | 5/2004 | Mares | 52/62 |
| 2004/0182037 | A1 * | 9/2004 | Sourlis | 52/606 |
| 2006/0283102 | A1 * | 12/2006 | Sourlis | 52/62 |
| 2009/0158675 | A1 * | 6/2009 | Sourlis | 52/101 |
| 2010/0011675 | A1 * | 1/2010 | Creech | 52/62 |
| 2011/0302863 | A1 * | 12/2011 | Sourlis | 52/302.1 |
| 2012/0279153 | A1 * | 11/2012 | Keene | 52/302.1 |

* cited by examiner

*Primary Examiner* — Ryan Kwiecinski
(74) *Attorney, Agent, or Firm* — McDonnell, Boehnen, Hulbert & Berghoff LLP

(57) ABSTRACT

A flashing and drainage system for use in a cavity wall construction, including a flashing member, is disclosed. The flashing member includes an upper portion and a lower portion. The flashing member may be provided in the form of a continuous roll.

4 Claims, 4 Drawing Sheets

DRAINAGE SYSTEM FOR USE IN BUILDING CONSTRUCTION

CROSS-REFERENCE TO RELATED APPLICATIONS

The present application claims benefit of Provisional Application No. 61/589,653, filed Jan. 23, 2012, the entirety of which is incorporated herein by reference.

FIELD OF THE INVENTION

The present application relates generally to systems, such as are used in association with cavity wall construction, which function to reduce or prevent water damage entering or trapped in the wall. More particularly, the application is directed to a system which includes flashing elements which function to direct water from a wall in which it is installed, drainage elements associated with the flashing elements to direct water from the flashing, and additional elements to prevent mortar and debris from interfering with drainage.

BACKGROUND

The present application is at least applicable to so-called cavity wall construction. Cavity walls may be composed of two wythes of masonry, usually brick and concrete block, which may be secured together by, for example, metal ties and spaced apart by a cavity between the wythes. The inner wall may be constructed from wood with an inner surface of drywall, structural clay tile, vertical stacks of mortared bricks or blocks, or a shear concrete surface, for example. The outer wall is typically formed of bricks and held together by mortar. A space, or cavity, exists between the two walls, in part for drainage purposes and which may also be partially filled with insulation. It is Applicant's understanding that the Brick Institute defines a "cavity wall" as having a space greater than about 2 inches but not more than 4 inches between the wythes. However, the present application is useful in spaces between inner and outer walls spaced apart less than 2 inches, and more than 4 inches.

In conventional cavity wall construction, flashing is typically installed atop the foundation and weep holes are formed to collect moisture and drain the cavity. Moisture may penetrate the exterior wythe of the wall through a number of places, including top caps, copings, sills, windows, and may penetrate the wall itself through cracks or weaknesses, for example. It is well established that moisture is undesirable in brick or similar wall construction. The presence of water in freezing temperatures may cause cracks in the wall when water expands as it freezes. Trapped water may cause discolorations and other problems, and may even migrate into the dwelling. Another hazard of failing to deal with water is the formation of mold. It is widely accepted that mold growth can damage a building or render the building uninhabitable for various reasons. These reasons include a dangerous situation where the mold growth produces toxins and/or allergens sufficient to sicken inhabitants.

To overcome the problems associated with trapped water, weep holes are commonly included along the base of the outer side of and in the lowermost course of bricks or other masonry units. The weep holes allow water to pass from inside the wall. Also, the weep holes permit water to drain outside the wall structure. A flashing disposed in the wall cavity directs the collected water toward the weep holes.

A problem of cavity wall construction occurs during construction of a cavity wall, when excess mortar and other debris falls into the cavity. When the bricks or blocks are stacked during the erection of the wall, for example, mortar droppings are squeezed into the cavity. The excess mortar materials, as well as other debris, such as insulation, drops to the base of the cavity, and can block weep holes. The same problem can reduce the effectiveness of flashing. To address this problem, inserts, generically referred to as a cavity mortar collection device, may be used in the cavity. Successful devices designed to address the problem of moisture and debris in cavity wall construction are shown, for example, in U.S. Pat. Re. 36,676, incorporated herein by reference.

SUMMARY OF THE INVENTION

In one embodiment, a flashing and drainage system for use in cavity wall construction is disclosed. The system of this embodiment includes a flashing member sized and shaped to be received within a cavity of the wall, the flashing member preferably including a lower flashing portion which is oriented generally horizontally atop a foundation portion of the wall, and an upper flashing portion which is oriented generally vertically within the cavity of the wall, wherein the flashing member is flexible along the length of the flashing member and most preferably capable of being rolled, as into a cylindrical shape. The foregoing embodiment further includes a water permeable body disposed on the flashing member and extending across the lower flashing portion. This can be in the form of one or more weep tabs, the weep tabs being spaced apart to correspond to weep holes formed through the wall. In this version, a plurality of connecting portions connecting repeating patterns of weep tabs and water permeable bodies is provided. The connecting portions are not connected with adhesive to the flashing portion, and extend across the upper flashing portion. In this form, there are one or more porous bodies, wherein the water permeable body has a porosity sufficient to permit water to pass therethrough but substantially insufficient to permit mortar and debris to pass therethrough.

In another embodiment, the system includes a flashing member having a long length and a width, including an upper portion and a lower portion, the flashing member being capable of being rolled along its length, as into a cylindrical shape. The system further includes a plurality of drainage channels formed on at least the upper portion, the drainage channels being defined by raised parts extending generally along the width of the upper portion. The drainage channels preferably communicate with weep channels on the lower portion. In this embodiment, one or more bearing members are provided on the lower portion between which the weep channels pass. In a preferred version, a scrim extends across at least the upper portion, the scrim being spaced from the flashing member by raised parts of the drainage channels. The upper portion in use is oriented generally vertically in the cavity wall construction along an inboard side of the cavity, and the lower flashing portion in use is oriented generally horizontally atop a foundation of the wall construction.

These and other aspects, advantages, features and objectives of the present invention will be further understood upon consideration of the following description of certain embodiments, taken in conjunction with the drawings, in which:

DETAILED DESCRIPTION OF EMBODIMENTS OF THE INVENTION

In the following detailed description, reference is made to the accompanying Figures, which form a part thereof. In the Figures, similar symbols typically identify similar components, unless context dictates otherwise. The illustrative embodiments described in the detailed description, figures, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are contemplated herein.

Figure 1:
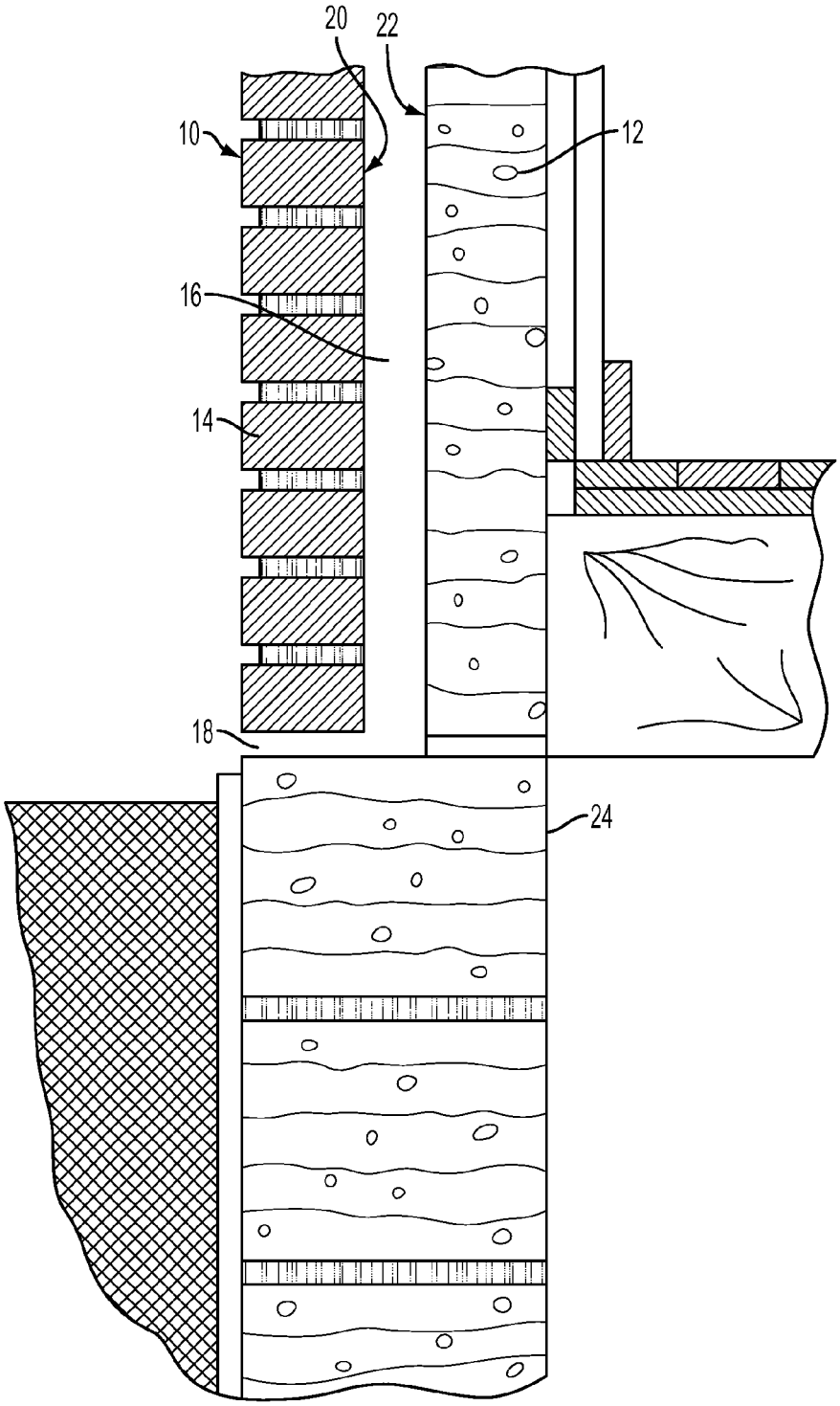
FIG. 1 shows a conventional cavity wall construction in cross section.

A cavity wall 10, as shown in FIG. 1, may include two wythes 12, 14 of masonry built upon a foundation 24. The two wythes are separated by an air space 16. The interior wythe (the inner wall) 12 may be brick, hollow brick, structural clay tile, wood or hollow or solid concrete masonry units, for example. The exterior wythe 14 (the outer wall) may be brick. A cavity 16 is defined between the two wythes, i.e., between inner or interior faces 20, 22 of outer and inner walls 14, 12 respectively. The cavity 16 may be either provided with insulation or left open as air space. The cavity 16 has a typical width of about 2 to about 4½ inches, but could be smaller, although non-standard. Of course, the wall 10 may be brick or block construction and may have components formed from wood, stud, steel stud and other construction techniques, materials and methods, which include a cavity 16 or the equivalent.

As mentioned above, a common problem associated with a cavity wall construction is how to allow moisture, as from seepage or condensation, for example, to pass from the cavity 16 to outside the wall 10. Weep holes 18 are formed to provide an unobstructed opening passing from the cavity to the outside of the wall. Generally, the weep holes 18 will be placed approximately one to two feet apart at the base of the outer wall 14. It has been found that moisture collecting in the cavity tends to run down the inside face 20 of the outer wall 14.

In the course of construction of a cavity wall 10, mortar and other debris (not shown) will commonly fall into the cavity 16 between the inner wall 12 and outer wall 14. If enough mortar builds up around the weep holes 18, or if it simply lodges in the weep holes, the weep holes will become plugged, causing water to pond between the walls 12, 14. The water can then leak into the foundation 24, building structure, or cause cracking, deterioration and/or discoloration of the walls.

Figure 2:
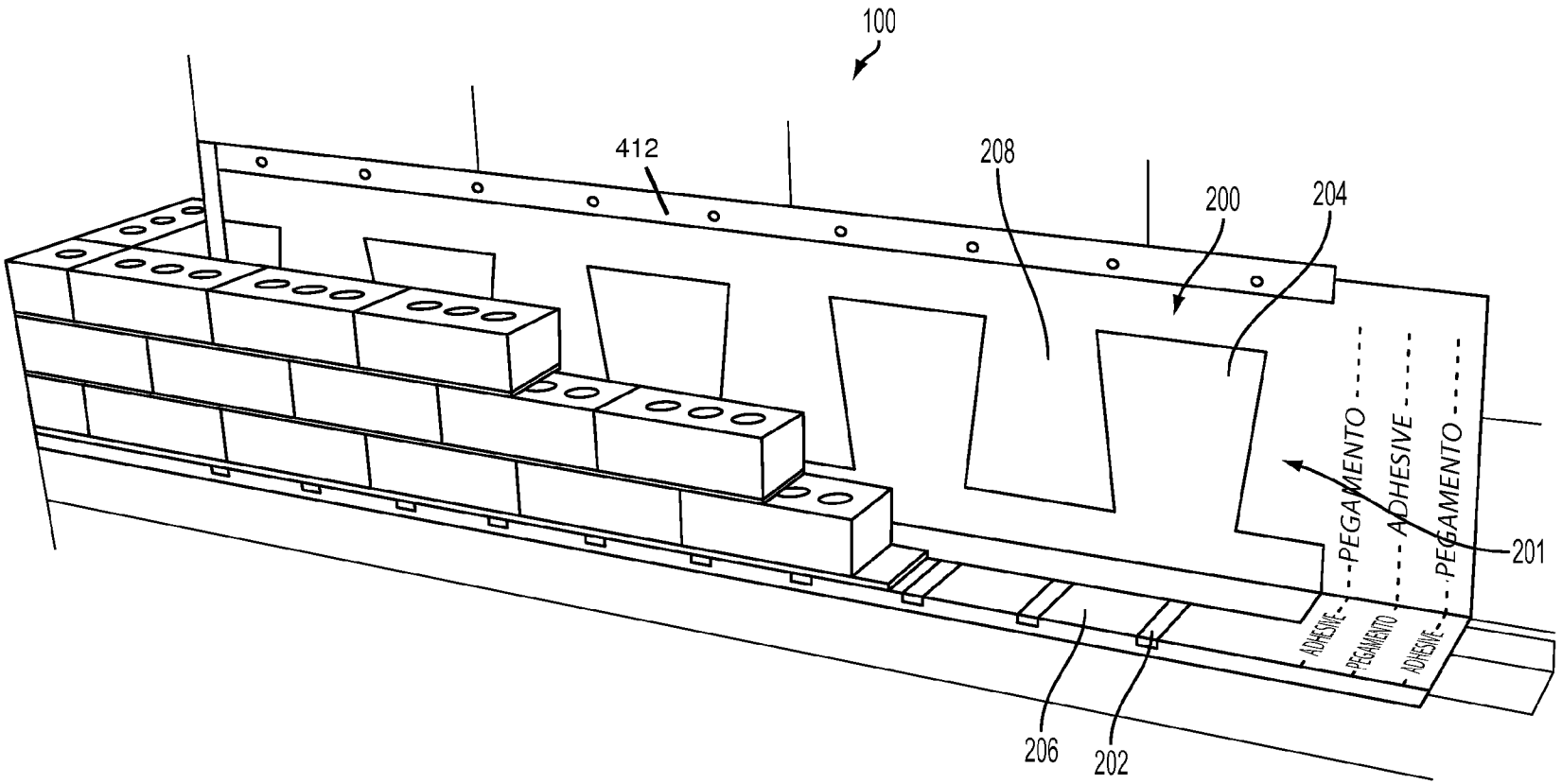
FIG. 2 shows a perspective view of a flashing and drainage assembly according to one embodiment.

Referring to FIG. 2, an example drainage system 100 is illustrated for use in connection with cavity wall construction. The drainage system 100 includes a flashing member 200. The flashing member 200 is provided with a single-piece water permeable body 201 including one or more spaced weep tab portions 202. The water permeable body 201 also includes one or more vertical mesh portions 204.

The flashing member 200 may be any conventional flashing material, for example stainless steel, cold-rolled copper, lead coated copper, galvanized steel, copper laminates and other metals, for example, aluminum, EPDM (man-made rubber), rubberized asphalt, polyvinyl chloride (PVC) and other plastics and composite materials. In one example, the flashing member 200 is formed of modified bitumen and more preferably, includes a "peel-and-stick" type adhesive and protective backing sheet (not shown) on a backside thereof.

In one embodiment, the flashing member 200 is generally rectangular and may advantageously be about 5-7 feet in length and includes a lower flashing portion 206 and a more upright upper flashing portion 208. The flashing member 200 may be other lengths as needed or desired. In one embodiment, a plurality of flashing members 200 may be connected to each other at a lap joint, where adjacent members 200 overlap.

The lower flashing portion 206 is positioned over the top of a foundation of a building or the like, or a lower course of bricks, or blocks and so on. The upper flashing portion 208 is positioned generally vertically in a wall cavity 16 and spaced from an inside face 20 of the outer wythe 14, and in contact with an inner face 22 of the inner wythe 12. The upper flashing portion 208 is kept spaced from the inside face 20 of the outer wythe 14 by pressure between the brick of the outer wythe and the mesh material 204.

The water permeable body 201 is in one example formed as a single unitary element including weep tabs 202 and vertical mesh bodies 204 extending therefrom. The weep tabs 202 are positioned atop the lower flashing portion and are sized, shaped and spaced to extend through the weep holes 18 of a wall 10. The tabs 202 are formed of a porous and/or draining material, like open mesh plastic, cotton, wool or hemp material capable of functioning to transmit water from atop the flashing 200 and out the weep holes 18. In the illustrated embodiment, the weep tabs 202 are spaced strips of material extending from body 201 in alignment with the vertical mesh portions 204.

The vertical mesh bodies 204 are positioned on the upper flashing portion 208 and spaced in a manner to deflect and/or prevent debris and mortar from occluding the tabs 202. Furthermore, the depth of the vertical bodies 204 are provided so as to space the vertical flashing portion 208 from the inner face 20 of the outer wall 14 and generally adjacent the inner face 22 of the inner wall 12. In one example, the vertical bodies 204 are about 1 inch thick. The mesh bodies may take many sizes and shapes, and may be a monolithic piece.

Figure 3:
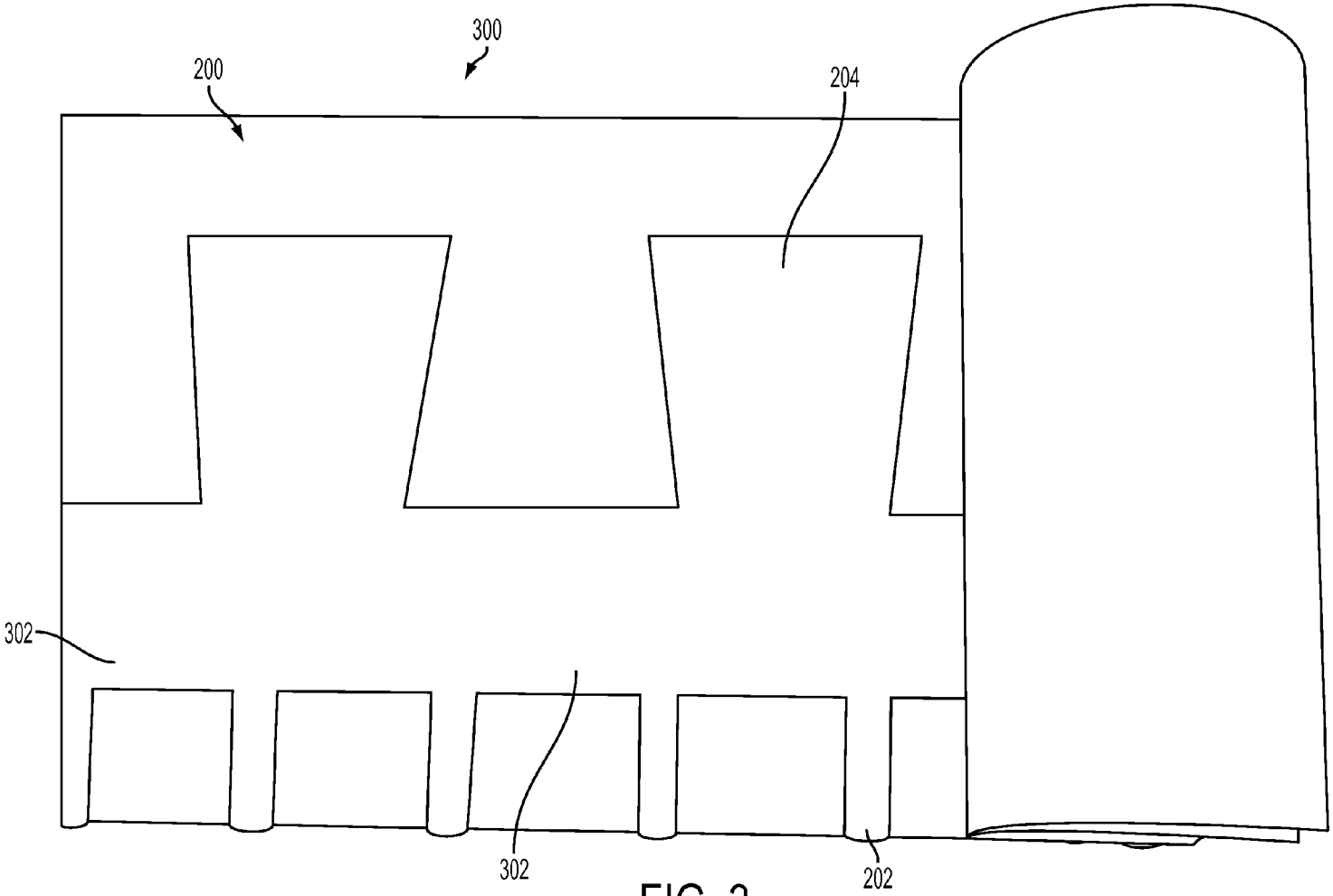
FIG. 3 shows a front view of a flashing and drainage assembly in a rolled configuration.

In one embodiment, the flashing member 200 may be constructed as a continuous roll 300, as shown in FIG. 3. The roll may be 50 feet long, for example. In this embodiment, the flashing member 200 may be customized to a desired length for a particular application. The flashing member 200 may include a plurality of connecting portions 302 which connect repeating patterns of weep tabs 202 and vertical bodies 204. The connecting portions 302 do not, in this embodiment, include adhesive connecting the water permeable body 201 to the flashing member 200. Moreover, the lap joint area is designed to readily expose the flashing below, with little effort required to remove overlying layers/material, if any. Thus, lap joints may be easily formed at any of the connecting portions 302 when creating a customized length of the flashing member 200.

Moreover, this connecting portion or region of the flashing member may be made without any adhesive thereon in stock manufacture (i.e., as provided to the end user). The overlying materials in the form of porous mesh and/or weep material, may either be removed in this connecting portion, or present but not attached (so as to be readily removable in the field). Further, the connecting region could be provided with an adhesive, with a release sheet overlying the adhesive. Thus, the release sheet could be removed and the adhesive thereby readily exposed.

Figure 4:
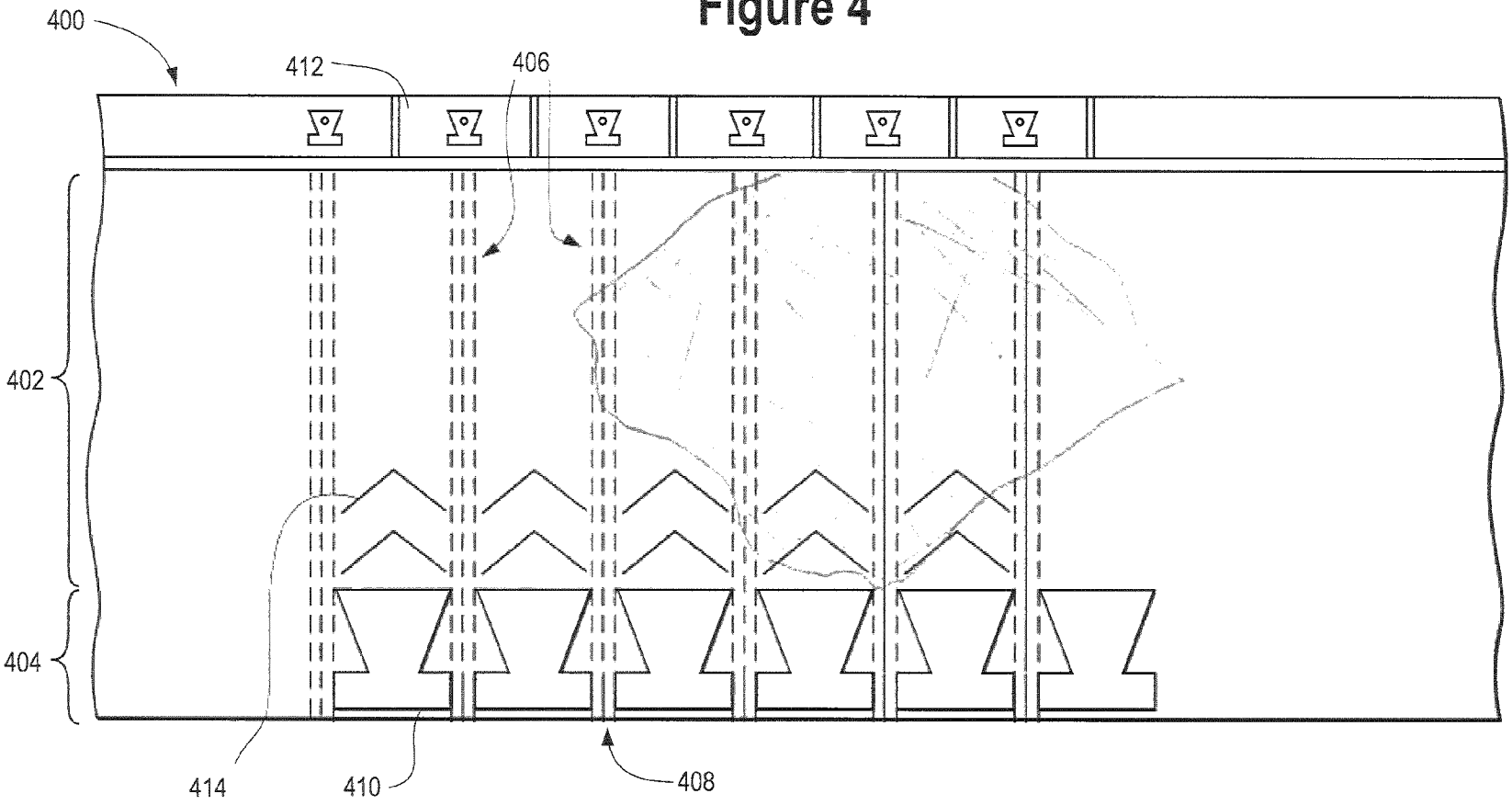
FIG. 4 shows a front view of a flashing and drainage assembly according to another embodiment.

Another embodiment of a flashing member 400 is shown in FIG. 4. The flashing member 400 has a long length and a width, and includes an upper portion 402 oriented generally vertically in the cavity wall construction, and a lower portion 404 oriented generally horizontally atop a foundation of the wall construction.

In one embodiment, the flashing member 400 is formed by connecting a plurality of generally rectangular-area pieces end to end within the cavity. The flashing member 400 may be flexible and capable of being rolled into a cylindrical shape, such as the roll shape shown in FIG. 3.

The flashing portion 400 includes a plurality of drainage channels 406 formed on at least the upper portion 402. The drainage channels 406 are defined by raised parts extending generally along the width of the upper portion 402. In one embodiment, the raised parts may be ribs. The drainage channels 406 each communicate with weep channels or outlets 408 located in the lower portion 404. In one embodiment, the drainage channels 406 also form the weep channels 408.

The flashing member 400 further includes one or more bearing members 410 located on the lower portion 404. The bearing members 410 may be molded onto the lower portion 404. The bearing members may be solid and may be raised up from the lower portion. The bearing members 410 may be of sufficient strength to support a masonry wall thereon without compressing completely flat so as to keep the weep channels open to water drainage.

A scrim or mesh (not shown) may extend across at least the upper portion 402 of the flashing member 400. The scrim may be spaced from the flashing member by the raised parts of the drainage channels 406. In some embodiments, the scrim may extend across both the upper and lower flashing portions. The scrim allows moisture to reach the drainage channels, and also prevents large particulate matter from blocking the channels.

The flashing member 400 may also include a termination bar or strip 412 along the upper portion 402. The termination bar 412 may be adapted to receive fixation elements, such as fasteners, for attachment to the inboard side of the cavity. In one embodiment, the termination bar 412 may be molded in, rather than a separate component, and may be thicker than the other area of the membrane for added resistance to fasteners pulling through. The termination bar may be articulated to allow rolling or folding, or may be segmented to the same end.

The flashing member 400 may further include elongated angle portions 414 located between the drainage channels 406. The angles portions 414 may have a downward slope toward the respective drainage channel 406, which serves to direct water flowing down the upper flashing portion 402 toward a drainage channel 406.

In some embodiments, a connection portion or transition zone may be located between adjacent bearing members 410. The transition zones do not include adhesive connecting the bearing members 410 to the flashing member 400. Thus, as mentioned above, lap joints may be easily formed at any of the transition zones when creating a customized length of the flashing member 400.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A flashing and drainage system for use in cavity wall construction, comprising:

a flashing member having a length and being sized and shaped to be received within a cavity of the wall, the flashing member including a lower flashing portion which is oriented generally horizontally atop a foundation portion of the wall and an upper flashing portion which is oriented generally vertically within the cavity of the wall, wherein the flashing member is flexible along the length and capable of being rolled or folded upon itself;

one or more water permeable bodies affixed to the flashing member;

one or more weep tabs located on the lower flashing portion, the one or more weep tabs being spaced apart to correspond to weep holes formed through the wall; and a plurality of connecting portions connecting adjacent ones of the one or more weep tabs and the one or more water permeable bodies, wherein the plurality of connecting portions are not directly affixed to the lower flashing portion so as to enable one or more of the connecting portions to be removed when one flashing member is attached to another flashing member, and wherein each of the one or more water permeable bodies has a porosity sufficient to permit water to pass therethrough but substantially insufficient to permit mortar and debris to pass therethrough;

the flashing member having a lap portion on and at an end which does not have any adhesive provided thereon in stock manufacture, and to which the one or more water permeable bodies and the one or more weep tabs are not affixed in stock manufacture, said lap portion providing an area for ready overlap and attachment to another adjacent flashing member.

2. The flashing and drainage system of claim 1, wherein the one or more water permeable bodies, the one or more weep tabs and the plurality of connecting portions are a monolithic piece, with the one or more water permeable bodies being affixed to the flashing member in manufacture.

3. The flashing and drainage system of claim 1, further including a termination bar along the upper flashing portion, the termination bar being formed in segments or of a flexible material which thereby permits the system to be rolled or folded upon itself, the termination bar being adapted to receive fixation elements for attachment to an inboard side of the cavity.

4. The flashing and drainage system of claim 1 wherein the system is formed in generally rectangular-area pieces which are connected in use end to end within the cavity.

* * * * *